US011441401B2

(12) United States Patent
Shaw

(10) Patent No.: US 11,441,401 B2
(45) Date of Patent: Sep. 13, 2022

(54) HYBRID GAS LIFT SYSTEM

(71) Applicant: Silverwell Technology Ltd., Histon (GB)

(72) Inventor: Joel David Shaw, Houston, TX (US)

(73) Assignee: SILVERWELL TECHNOLOGY LTD., Cambridgeshire (GB)

( * ) Notice: Subject to any disclaimer, the term of this patent is extended or adjusted under 35 U.S.C. 154(b) by 0 days.

(21) Appl. No.: 17/171,211

(22) Filed: Feb. 9, 2021

(65) Prior Publication Data

US 2021/0246770 A1 Aug. 12, 2021

Related U.S. Application Data

(60) Provisional application No. 62/972,421, filed on Feb. 10, 2020.

(51) Int. Cl.

| | |
|---|---|
| ***E21B 34/16*** | (2006.01) |
| ***E21B 43/12*** | (2006.01) |
| ***E21B 47/06*** | (2012.01) |

(52) U.S. Cl.

CPC ..... *E21B 43/123* (2013.01); *E21B 34/16* (2013.01); *E21B 47/06* (2013.01)

(58) Field of Classification Search

CPC ..... E21B 34/08; E21B 34/16; E21B 43/123; E21B 47/06

See application file for complete search history.

(56) References Cited

U.S. PATENT DOCUMENTS

| | | | | |
|---|---|---|---|---|
| 3,646,953 A | | 3/1972 | Elliott et al. | |
| 4,340,088 A | | 7/1982 | Geisow | |
| 4,471,841 A | | 9/1984 | Rector, Jr. | |
| 4,519,574 A | | 5/1985 | Roper | |
| 4,796,699 A | | 1/1989 | Upchurch | |
| 4,972,704 A | * | 11/1990 | Wellington | E21B 49/087 73/152.18 |
| 5,000,215 A | | 3/1991 | Phillips | |
| 5,172,717 A | * | 12/1992 | Boyle | E21B 34/16 137/155 |
| 5,865,272 A | | 2/1999 | Wiggins et al. | |
| 6,325,153 B1 | | 12/2001 | Harrell | |
| 6,364,023 B1 | | 4/2002 | Hiron et al. | |
| 6,619,388 B2 | | 9/2003 | Dietz et al. | |

(Continued)

FOREIGN PATENT DOCUMENTS

| | | |
|---|---|---|
| EP | 1018593 A1 | 7/2000 |
| WO | 02059457 A1 | 8/2002 |

OTHER PUBLICATIONS

PCT ISRWO dated May 12, 2021, in the prosecution of application PCT/GB2021/050307, 13 pages.

*Primary Examiner* — Matthew R Buck

(74) *Attorney, Agent, or Firm* — Bracewell LLP; Constance G. Rhebergen; Keith R. Derrington

(57) ABSTRACT

Liquid is unloaded from a well with a hybrid gas lift system that includes a lift gas source and valves for injecting lift gas into production tubing. The types of valves include pressure production operated ("PPO") valves and a surface operated valve. Pressure inside the production tubing is measured to monitor operation of the PPO valves, and identify if the PPO valves are experiencing and anomaly, such as multi-pointing or chattering. The surface operated valve is selectively actuated to correct anomalous operation of the PPO valves.

19 Claims, 7 Drawing Sheets

(56) References Cited

U.S. PATENT DOCUMENTS

| | | | | |
|---|---|---|---|---|
| 6,715,550 | B2 * | 4/2004 | Vinegar | E21B 47/107 166/250.15 |
| 7,743,833 | B2 | 6/2010 | Cascarion et al. | |
| 8,464,799 | B2 | 6/2013 | Scott et al. | |
| 9,810,343 | B2 | 11/2017 | Miller et al. | |
| 11,078,775 | B2 * | 8/2021 | Romer | E21B 47/09 |
| 2002/0108747 | A1 | 8/2002 | Diez et al. | |
| 2009/0188662 | A1 | 7/2009 | Casciaro et al. | |
| 2019/0316451 | A1 | 10/2019 | Al-Gouhi | |
| 2021/0131238 | A1 * | 5/2021 | Stojkovic | E21B 43/123 |
| 2021/0198988 | A1 * | 7/2021 | Ramakrishnan | E21B 43/122 |

* cited by examiner

Ax
42
49
40
10
20
48
F50
22
24
26
50
21
24
34
30 1
36
32 1
28
46
30 2
32 2
F18
30 3
12
32 3
18
17
30 4
32 4
L
44
30 5
32 5
38
19
14
16
F14

Ax
42
49
40
10
20
48
F50
22
24
26
50
21
24
34
30 1
32 1
28
46
30 2
32 2
36
F18
30 3
12
32 3
18
17
30 4
32 4
L
44
30 5
32 5
38
19
14
16
F14

Ax
42
49
40
10
20
48
F50
22
24
26
50
21
24
34
30 1
32 1
28
46
30 2
32 2
F18
30 3
12
32 3
36
18
17
30 4
32 4
L
44
30 5
32 5
38
19
14
16
F14

Ax
42
49
40
10
20
48
F50
22
24
26
50
21
24
34
30 1
32 1
28
46
30 2
32 2
F18
30 3
12
32 3
18
17
30 4
36
32 4
L
44
30 5
32 5
38
19
14
16
F14

Ax
42
49
40
10
20
48
F50
22
24
26
50
21
24
34
30 1
32 1
28
46
30 2
32 2
F18
30 3
12
32 3
18
17
30 4
36
32 4
44
30 5
32 5
L
38
19
14
16
F14

Ax
42
49
40
10
20
48
F50
22
24
26
50
21
24
34
30 1
32 1
28
46
30 2
32 2
F18
30 3
38 2
12
32 3
36
18
17
30 4
32 4
L
44
30 5
32 5
38 1
19
14
16
F14

HYBRID GAS LIFT SYSTEM

CROSS-REFERENCE TO RELATED APPLICATION

This application is claims priority to and the benefit of U.S. Provisional Application Ser. No. 62/972,421, filed Feb. 10, 2020, the full disclosure of which is incorporated by reference herein in its entirety and for all purposes.

BACKGROUND OF THE INVENTION

1. Field of Invention

The present disclosure relates to using lift gas to increase fluid production from a well.

2. Description of Prior Art

Lift systems for unloading liquids from a well include pumps, such as electrical submersible pumps ("ESP"), which pressurize the liquid downhole and propel it up production tubing that carries the pressurized fluid to surface. Sucker rods and plunger lift pumps are also sometimes employed for lifting liquid from a well. In wells having an appreciable amount of gas mixed with the liquid a two-phase fluid may form and gas is sometimes separated from the fluid upstream of the ESP and routed to surface separately from the pressurized liquid. In some instances compressor pumps are employed to pressurize the two-phase fluid to lift it to surface. A gas lift system is another type of artificial lift system, and that injects a lift gas, typically from surface, into production tubing installed in the well. The lift gas is usually directed into an annulus between the production tubing and sidewalls of the well, and from the annulus into the production tubing. Gas lift is commonly employed when pressure in a formation surrounding the well is insufficient to urge fluids to surface that are inside of the production tubing. By injecting a sufficient amount of lift gas into the production tubing, static head pressure of fluid inside the production tubing is reduced to below the pressure in the formation, so that the formation pressure is sufficient to push the fluids inside the production tubing to surface. Fluids that are usually in the production tubing are hydrocarbon liquids and gases produced from the surrounding formation. Sometimes these fluids are a result of forming the well or a workover, and have been directed into the production tubing from the annulus.

The lift gas and fluid in the annulus is typically injected into the production tubing through valves that are in communication with ports intersecting sidewalls of the production tubing. An injection pressure operated ("IPO") gas lift valve is one type of valve for injecting lift gas into production tubing, and are typically disposed at various depths along the production string. IPO valves are usually designed to close in response to pressure in the annulus, and with staggered closing pressures so the lowermost valve is set to close at the lowest annulus pressure. Production pressure operated ("PPO") gas lift valves are another type of valve used for gas lift injection. PPO valves are also mounted at different locations along the production string and have staggered set pressures; but operate in response to pressure inside the production tubing rather than in the annulus, and with the lowermost valve closing at the highest set pressure. Generally both IPO and PPO valves include a spring or are nitrogen charged and that automatically open or close at designated set pressures. Another type of valve is one that is surface controlled and whose operation is not dependent on annulus or tubing pressure, generally the number of surface controlled valves is lower than the number of IPO or PPO valves, and can be as few as a single valve; however the surface controlled valves tend to be expensive as compared to the IPO or PPO valves. Disadvantages of IPO valves is that annulus pressure can sometimes exceed the set pressure, which can limit the depth of the gas injection and reduce production. Disadvantages of the PPO valves is that some operational problems are generally not detectable, such as if some of the PPO valves begin to multi-point or chatter, in both conditions production capacity of the well is reduced as well as system reliability. PPO valves primarily respond to pressure in the tubing, but can be slightly affected by pressure in the annulus; similarly IPO valves primarily respond to pressure in the annulus, but can be slightly affected by pressure in the tubing.

SUMMARY OF THE INVENTION

Disclosed herein is an example method of lifting liquid from a well that includes injecting lift gas into production tubing through production pressure operated ("PPO") valves that are in selective communication with a string of production tubing in the well, monitoring conditions in the production tubing, identifying a condition in the production tubing indicating one or more of the PPO valves is experiencing an anomaly, and correcting the anomaly by altering a characteristic of fluid in the production tubing. Alternatively, the step of correcting the anomaly involves directing a signal from surface to a surface controlled valve to adjust the amount of lift gas being injected into the production tubing. In one example, pressure in the production tubing is monitored to identify a condition in the production tubing indicating one or more of the PPO valves is experiencing an anomaly. In an embodiment, the anomaly being corrected is adjusting a rate of lift gas injection into the production tubing through a surface controlled valve or adjusting pressure of fluid flowing from the production tubing. Lift gas is optionally added into the production tubing through a surface controlled valve. The method optionally includes unloading liquid from an annulus surrounding the production tubing by pressurizing the annulus with lift gas, wherein the liquid is produced from a formation and that is directed into an end of the production tubing. In one alternative, the liquid is directed into the production tubing through the PPO valves.

Another example of method of well operations is disclosed and that includes providing lift gas into a well that is equipped with production tubing, production pressure operated ("PPO") valves on the production tubing, casing that lines the well, and an annulus defined between the producing tubing and the well, the PPO valves are selectively changed between an open configuration to define a path for a portion of the flow of the lift gas to enter into the production string from the annulus, and a closed configuration to block the flow of the lift gas to enter into the production string from the annulus, directing the lift gas into the annulus, maintaining a flow of the lift gas at a substantially constant rate into the annulus, and determining an anomalous operation of the PPO valves by monitoring conditions in the production tubing and correcting the anomalous operation of the PPO valves by adding lift gas into the production tubing through a valve that is controlled from surface. In an alternative, the method further includes maintaining a pressure of the lift gas at which one of the PPO valves in designed to be in an open configuration and that PPO valves at a lesser depth are designed to be in a closed configuration. In an alternate embodiment, the condition is pressure. The anomalous operation is optionally corrected by adjusting pressure in the production tubing or alternatively by adjusting an amount of lift gas being injected into the production tubing by a surface controlled valve.

An example system for use in well operations includes a source of lift gas having a line in communication with an annulus in the well that is defined between production tubing and casing that lines the well, production pressure operated ("PPO") valves provided at different depths along the production tubing that are selectively changed between an open configuration that forms a path through a sidewall of the production tubing and provides communication between the annulus and inside of the production tubing, and a closed configuration that forms a barrier in the path, a surface actuated valve that is changeable between an open configuration that forms a path through a sidewall of the production tubing and provides communication between the annulus and inside of the production tubing, and a closed configuration that forms a barrier in the path; and a controller that identifies an anomalous operation of the PPO valves, and corrects the anomalous operation of the PPO valves by selectively configuring the surface actuated valve into the open configuration. In an alternative, pressure in the production string is monitored by the controller. Pressure in a flow production line on surface is optionally monitored by the controller, and the controller identifies the anomalous operation of the PPO valves based on the monitored pressures. In one example, the surface controlled valve is at a greater depth than the PPO valves. Embodiments of the system also include pressure sensors and control lines, and where the controller, pressure sensors, and control lines define a communication circuit.

BRIEF DESCRIPTION OF DRAWINGS

Some of the features and benefits of the present invention having been stated, others will become apparent as the description proceeds when taken in conjunction with the accompanying drawings, in which.

Figure 1:
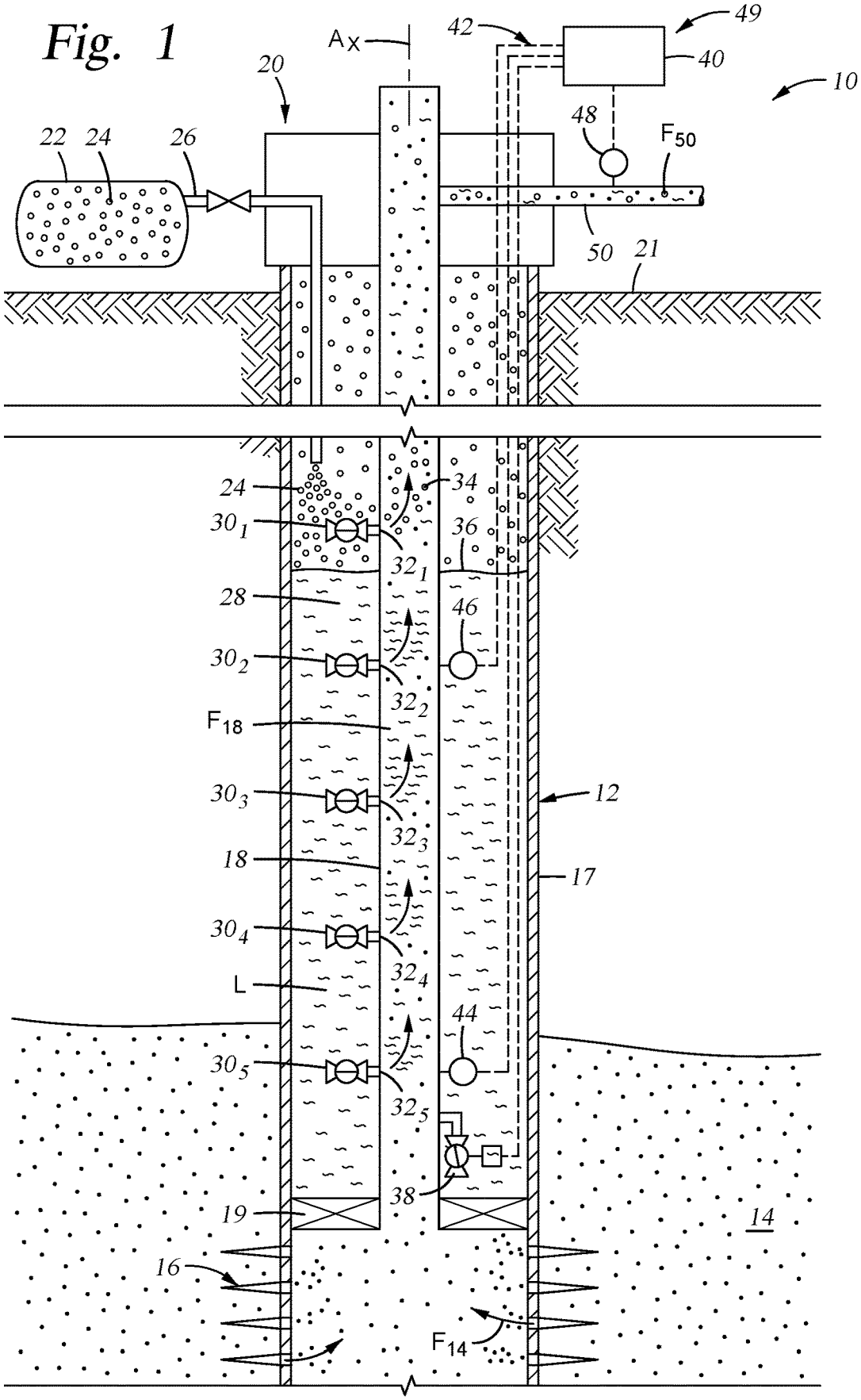
FIGS. 1-5 are schematic side sectional views of unloading a well using a lift gas injection system equipped with PPO valves and a system controlled valve.
Figure 2:
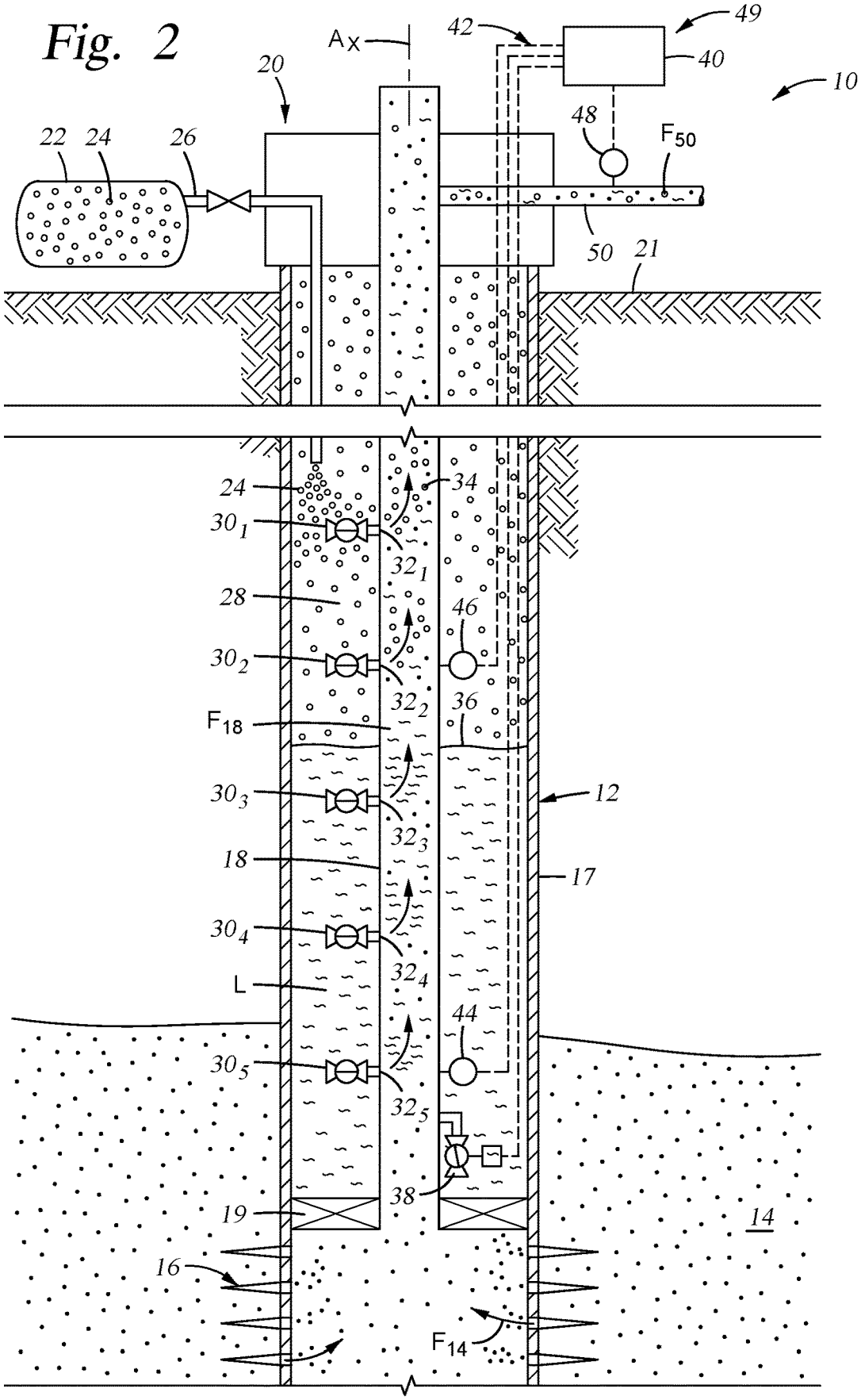
Figure 3:
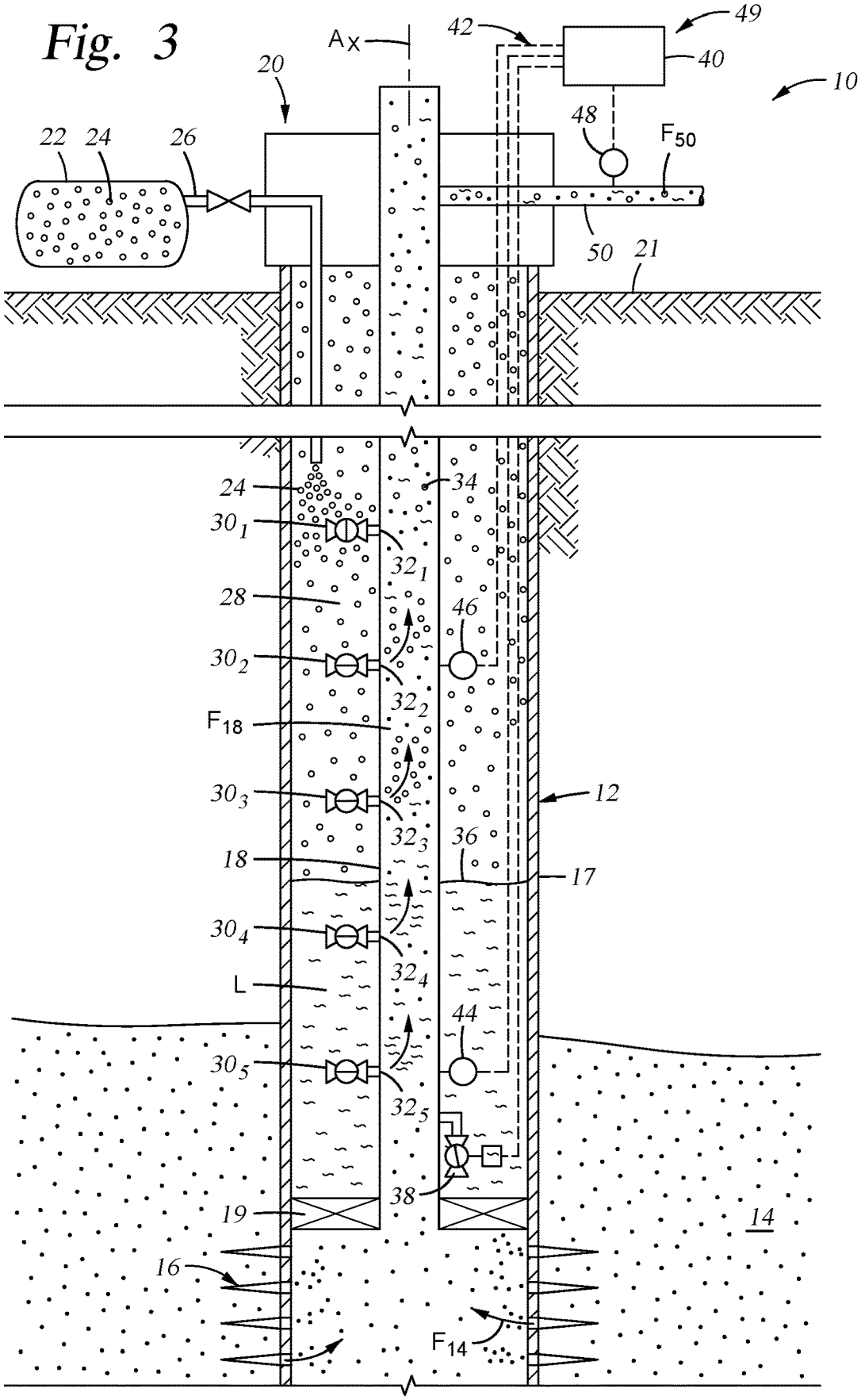

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side partial sectional view in FIGS. 1 through 5 is an example of a gas lift system 10 being used for unloading of a liquid L from a well 12. Well 12 is shown intersecting a subterranean formation 14 and having perforations 16 that extend radially outward from the well 12 into the formation 14. Perforations 16 also intersect casing 17 that lines the well 12. Production tubing 18 is inserted within the casing 17. Fluid $F_{14}$ is from formation 14 and shown exiting perforation 16 and is directed into the production tubing 18 by packers 19 that span between the tubing 18 and casing 17. Production tubing 18 is mounted on its upper end within a wellhead assembly 20 shown on surface 21. Included with gas lift system 10 is a lift gas source 22 shown containing an amount of lift gas 24. Examples of a lift gas source 22 include adjacent wells, a gas line manifold, in-situ gas from well 12, compressors, and other known or future developed sources of gas for use in a lift gas application. A line 26 attaches to a discharge of the lift gas source 22 and provides a conduit for transporting the lift gas 24 into an annulus 28 that is defined in a space between the production tubing 18 and casing 17. Alternatives of liquid L include fluids in the well 12 after commissioning, such as drilling fluids, and also include fluids in well 12 when no longer producing or when shut in.

Also included with the gas lift system 10 are a series of production pressure operated ("PPO") valves $\mathbf{30}_{1\text{-}5}$ that are shown mounted to an exterior of the production tubing 18 at different depths within the well 12. In alternatives, PPO valves $\mathbf{30}_{1\text{-}5}$ are inside production tubing 18. PPO valves $\mathbf{30}_{1\text{-}5}$ attach respectively to outlet ports $\mathbf{32}_{1\text{-}5}$ that extend through the sidewall of the production tubing 18. The PPO valves $\mathbf{30}_{1\text{-}5}$ of FIG. 1 are shown in an open configuration that provides a path through the PPO valves $\mathbf{30}_{1\text{-}5}$ for the communication of fluid and/or pressure. When PPO valves $\mathbf{30}_{1\text{-}5}$ are in the open configuration, annulus 28 and outlet ports $\mathbf{32}_{1\text{-}5}$ are in communication through the PPO valves $\mathbf{30}_{1\text{-}5}$ which provides for communication between annulus 28 and the inside of production tubing 18. The PPO valves $\mathbf{30}_{1\text{-}5}$ of FIG. 1 are selectively also configured into a closed configuration that blocks communication between the annulus 28 and outlet ports $\mathbf{32}_{1\text{-}5}$, which in turn blocks communication between annulus 28 and inside of tubing 18. In the illustrated example, the PPO valves $\mathbf{30}_{1\text{-}5}$ are automatically changeable between the open and closed configurations in response to pressure within the production tubing 18.

Figure 5:
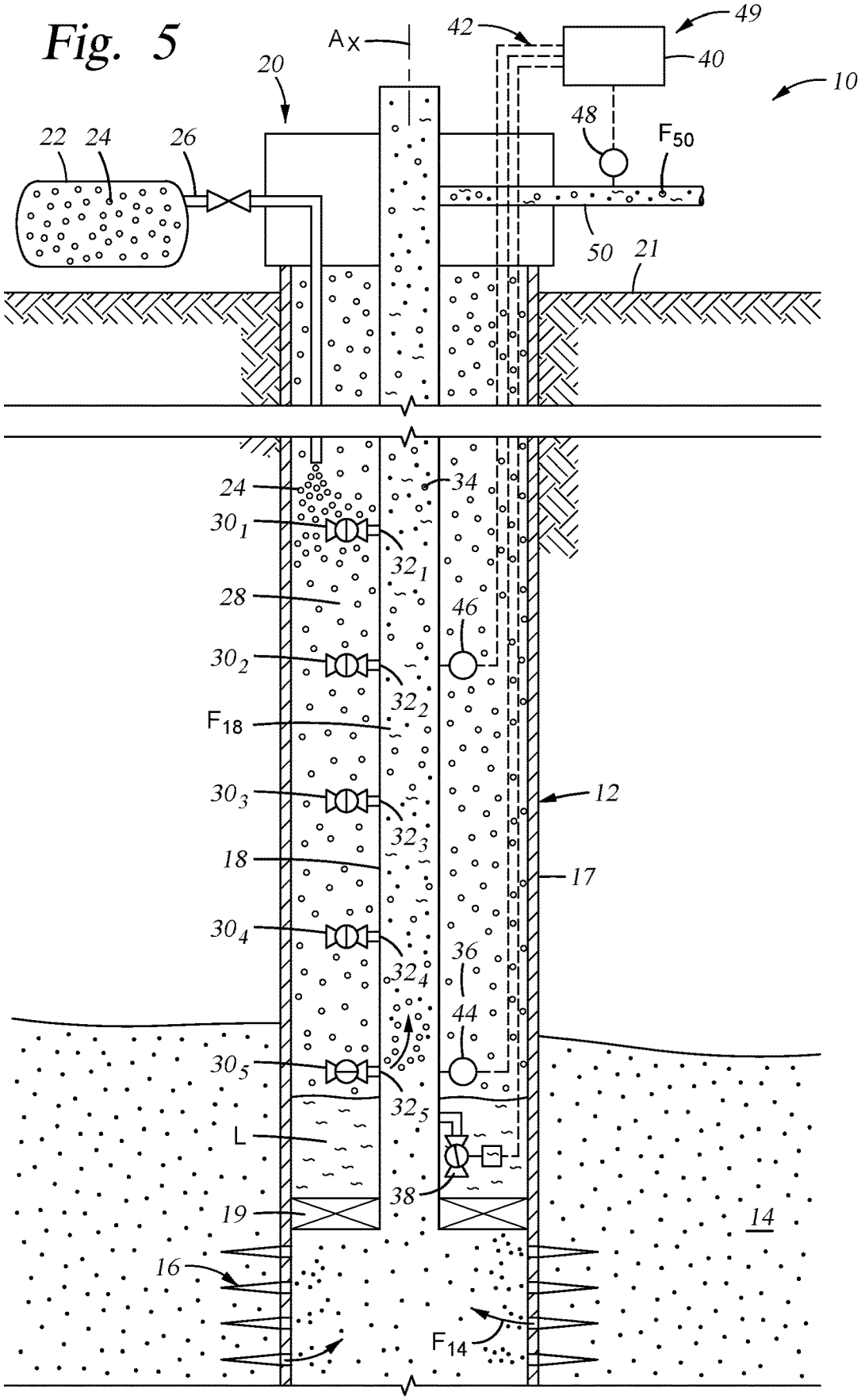

The example of FIG. 1 illustrates an example of unloading a liquid L shown in annulus 28 and at a depth that is between PPO valve $\mathbf{30}_1$ and PPO valve $\mathbf{30}_2$. A portion of annulus 28 above the level of liquid L is occupied by lift gas 22, where lift gas 22 contacts an upper level of liquid L defines an interface 36 shown in annulus 28 between valve $\mathbf{30}_1$ and valve $30_2$. Interface 36 is generally perpendicular to an axis $A_X$ of well. In an example step of unloading the liquid L, which begins prior to that as illustrated in FIG. 1, the introduction of the lift gas 24 increases pressure in the annulus 28 to above that of within the production tubing 18 and forces liquid L downward in the annulus 28, through the open PPO valves $30_{1-5}$ (and through the outlet ports $32_{1-5}$), and into the production tubing 18. As the volume of liquid L in annulus 28 is reduced, interface 36 drops below PPO valve $30_1$. At this stage, liquid L continues to flow through PPO valves $30_{2-5}$ but it is injection gas 24 that flows through PPO valve $30_1$, the outlet port $32_1$, and into the production tubing 18. Injection gas 24 inside of the production tubing 18 form gas bubbles 34 shown rising within the fluid $F_{18}$ that is flowing within the production tubing 18 within well 12 and upwards to the wellhead assembly 20. In an example fluid $F_{14}$ represents fluid produced from the formation 14, examples of which include one or more of hydrocarbon liquid, hydrocarbon gas, water, and combinations; and fluid $F_{18}$ includes a mixture of fluid $F_{14}$ and lift gas 24. Introducing lift gas 24 to the fluid $F_{18}$ reduces the density of fluid $F_{18}$ and in turn promotes flow of fluid $F_{18}$ upwards within production tubing 18. Continued addition of the lift gas 24 into annulus 28 continues to urge the liquid L through the PPO valves $30_{2-5}$; as shown in FIG. 5 addition of the lift gas 24 eventually removes the liquid L from the portion of the annulus 28 above the lowermost PPO valve $30_5$. It should be pointed out that the number of PPO valves for use with the gas lift system 10 is not limited to the number shown in the figures.

Figure 4:
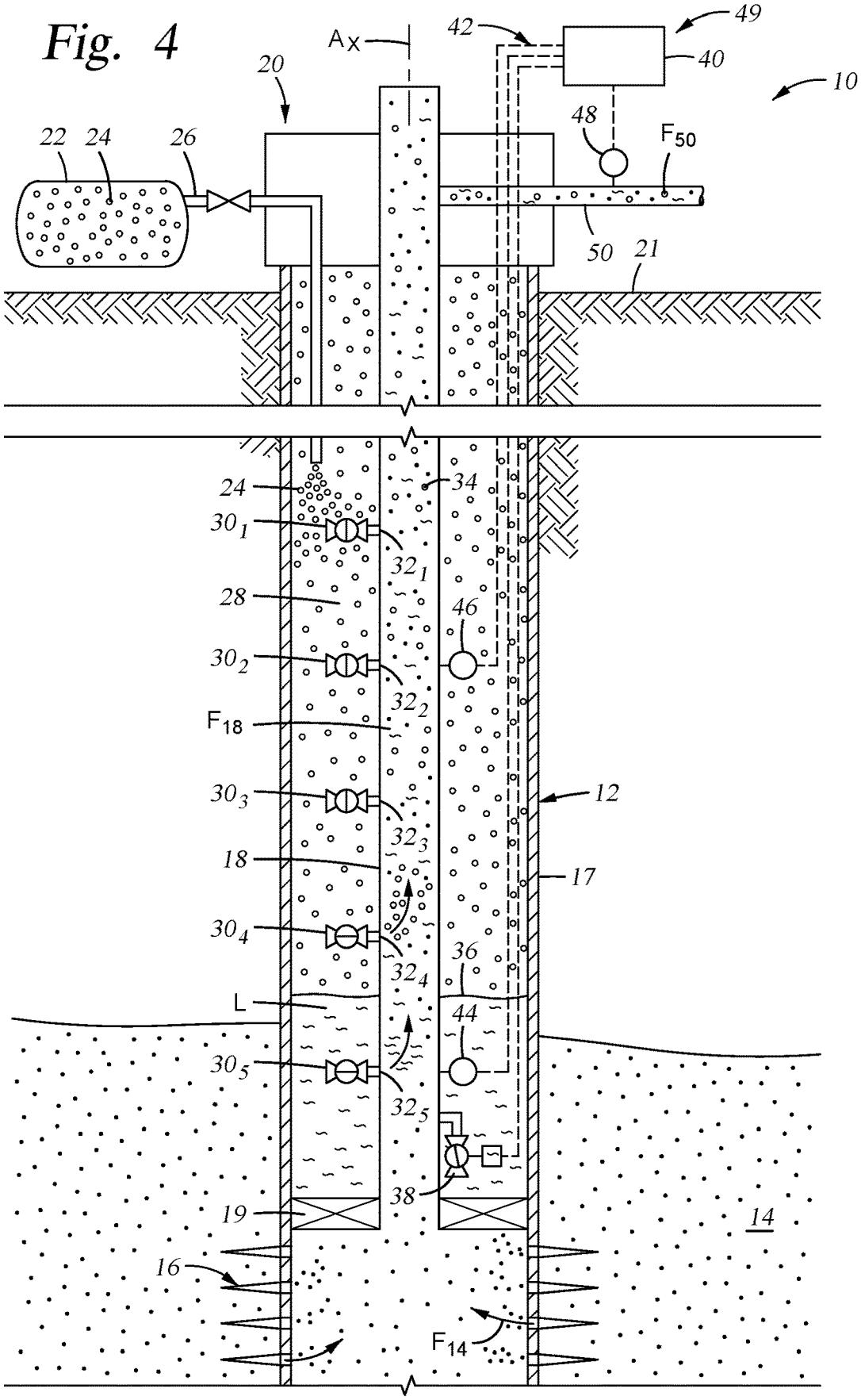

Referring back to FIG. 2 shown is that the continued introduction of the lift gas 24 into annulus 28 has urged the liquid L within annulus 28 to below the depth of the PPO valve $30_2$. In this example, PPO lift valves $30_1$ and $30_2$ are both shown in an open configuration and providing a flow of lift gas 24 into the production tubing 18 and producing lift gas bubbles 34. In an embodiment, the PPO lift valves $30_{1-5}$ have set pressures and are designed to automatically close upon pressure inside the production string 18 reaching a designated value. Additionally, the pressures are staggered so that adjacent valves close at different pressures and generally the greater the depth of the PPO valve $30_{1-5}$ the greater will be its closing pressure. In the example of FIGS. 1 through 5, PPO valve $30_1$ will automatically close at a pressure less than each of PPO valves $30_{2-5}$. Similarly, PPO valve $30_2$ will close at a lower pressure than any of $30_{3-5}$ and so on. In one alternative, an upper one of the PPO valves will remain in an opened configuration for a period of time after which the interface 36 drops below an adjacently lower PPO valve, so that for a period of time two adjacent PPO valves will be in an open configuration and while lift gas 24 is flowing through each of them; but in this example the upper PPO valve is designed to close before the interface 36 reaches the adjacent lower PPO valve so that lift gas 24 flows through no more than two PPO valves at the same time. In a further alternative of this example, the upper one of the adjacent PPO valves will automatically configure to its closed configuration, such as shown in FIG. 4 where interface 36 is between PPO valves $30_4$ and $30_5$ and PPO valves $30_{1-3}$ have automatically reconfigured into the closed configuration. As illustrated in FIG. 5, which is a final step of the example of unloading the liquid L from the annulus 28, the lowermost PPO valve $30_5$ remains in the opened configuration and provides for a flow of lift gas 24 into the production tubing 18.

Referring back to FIG. 1, a surface controlled valve 38 is included with the example of the gas lift system 10 and shown coupled with production tubing 18. Combining the surface controlled valve 38 with the PPO valves $30_{1-5}$ results in a gas lift system 10 sometimes referred to as a hybrid system. A hybrid system with PPO valves is able to inject lift gas 24 at greater depth than one with IPO valves (due to the closing pressure sequence), which provides an advantage of increased production of hydrocarbons from a well. An outlet port 39, similar to ports $32_{1-5}$, intersects production tubing 18 adjacent to where surface controlled valve 38 couples with production tubing 18. Surface controlled valve 38 is selectively put into an open configuration to create a communication path through valve 38, which provides flow and pressure communication between annulus 28 and port 39 through valve 38; that in turn provides communication between annulus 28 and the inside of production tubing 18. Surface controlled valve 38 is also selectively put into a closed configuration that blocks the flow path through the valve 38, and isolates port 39 from annulus 28. An example of a surface controlled valve 38 is described in Wygnanski, U.S. Pat. No. 8,925,638, and which is incorporated by reference herein its entirety and for all purposes. A controller 40 is shown located outside of wellbore 12, and that is in selective signal communication with surface controlled valve 38 via a communication circuit 42. Examples of communication circuits include means for transmission of communication; such as but not limited to wireless, fiber optics, hard-wired, and combinations. In an alternate example controller 40 is included within wellbore 12. Pressure sensors 44, 46, 48 are shown also in communication with the controller 40 via communication circuit 42. The combination of the controller 40, circuit 42, and sensors 44, 46, 48 define an intelligent well system 49. In the example, sensor 44 is depicted on a pressure tap adjacent the surface controlled valve 38, and alternatives exist in which pressure sensor 44 is integrated within or substantially next to surface controlled valve 38 and registers pressure within the production tubing 18 at or substantially adjacent where the surface controlled valve 38 attaches to outlet port 39 and provides communication between annulus 28 and inside of production tubing 18. In examples, operation of surface controlled valve 38 is managed by controller 40 and through the communication circuit 42. Alternatively, commands for operating the surface controlled valve 38 are delivered from above surface 21 and via communication circuit 42 but from a source other than controller 40. Illustrated in FIGS. 3 through 7 is that the fluid $F_{18}$ flowing upward within the production tubing 18 is diverted into a production line 50, within production line 50 fluid $F_{50}$ flows to a location remote from the well 12. In alternatives, a choke valve (not shown) is included in line 50, and optional locations of sensor 48 include upstream and downstream of choke valve, or pressure upstream and downstream of choke valve is measured by a combination of another sensor (not shown) and sensor 48.

Figure 6:
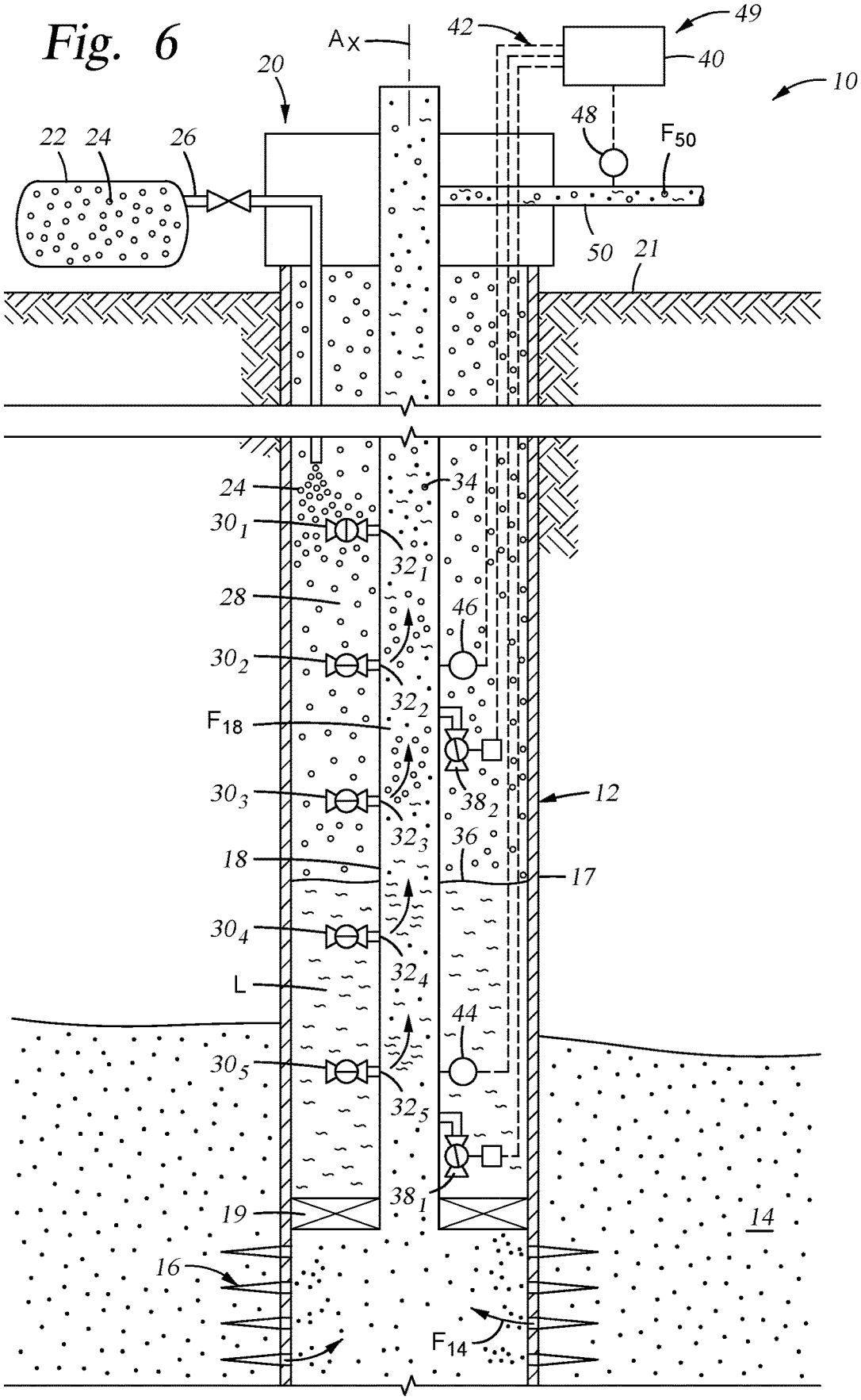
FIG. 6 is a schematic side sectional view of an example of the lift gas injection system of FIG. 1, and with PPO valves experiencing multi-pointing.

Shown in FIG. 6 as an example of a wellbore operation 10 and during which more PPO valves are undergoing an anomalous condition known as multi-pointing. Multi-pointing is a scenario in which more than two of the PPO valves above interface 36 are in the open configuration at the same time, and lift gas 24 is flowing into the production tubing 18 through these open PPO valves. Multi-pointing is an undesirable situation as the introduction of the lift gas 24 into production tubing 18 actually hinders a flow of fluid $F_{18}$ that is below the interface 36 from flowing upward to the wellhead assembly 20; a condition that is sometimes referred to as a choked flow. Not to be bound by theory, but choked flow occurs because a sufficient amount of the column of fluid $F_{18}$ in production tubing 18 remains substantially in liquid form and generates a static head at or below packers 19 which exceeds a pressure from within formation 14, so that fluid $F_{14}$ is unable to enter the production string 18. During an example of multi-pointing, lift gas 24 is being injected from more than one of the PPO valves $\mathbf{30}_{1\text{-}5}$ (which are each sometimes referred to as a valve station) because of an operational excursion in the production tubing 18 causing an unplanned or un-designed opening of one or of the PPO valves $\mathbf{30}_{1\text{-}5}$. Consequently all of the gas is not going through the lowest valve, and that reduces drawdown and therefore production. As far as production goes, choked flow refers to a situation where too much lift gas is being produced at the surface. In one example of an anomalous operation, an amount of lift gas flowing in the production tubing 18 exceeds a design flowrate of the wellhead assembly 20, production line 50, or a production manifold (not shown) and impedes a flow of fluid $F_{18}$ inside of or exiting the production tubing 18; impeding the flow of fluid $F_{18}$ in turn increases pressure of fluid $F_{18}$ at wellhead assembly 20, and/or the pressure of fluid $F_{50}$ inside production line 50. This can lead to reduced production because there is subsequently reduced drawdown downhole at the formation 14. It can also lead to multi-pointing because the pressure in the production tubing 18 increases. It can also cause unstable pressures in the production tubing 18 which can lead to chatter (i.e. repeated open and closed cycling of a valve at a frequency greater than design frequency and that can lead to valve damage).

In a non-limiting example of operation, controller 40 of system 49 is configured to recognize multi-pointing, such as by analysis of readings obtained by the sensors 44, 46, 48 and in turn provides instructions to operate surface controlled valve 38 and inject an amount of lift gas 22 into production tubing 18. In the example of FIG. 6, an additional surface controlled valve 382 is illustrated at a depth uphole of surface controlled valve $\mathbf{38}_1$. There are a number of ways to determine multi-pointing. In one example, multi-pointing is determined by a reduced injection rate at a surface controlled unit 38 downhole while there is the same rate of injection uphole (i.e. a flowrate of lift gas 24 being injected into the annulus 28 through line 26); indicating an increased amount of lift gas 24 flowing through the PPO valves $\mathbf{30}_{1\text{-}5}$. In an alternative to this example, the injection rate downhole is be determined by a known orifice size in the surface controlled valve 38 and a pressure differential across the orifice. Another option is to periodically and temporarily vary the orifice size (cross-sectional area) in the surface controlled valve 38 and monitor pressure at locations in the production tubing 18 to develop a pressure profile; based on the pressure profile it is determined if lift gas 24 is being injected in more than one of the PPO valves $\mathbf{30}_{1\text{-}5}$. Correcting a multi-pointing situation depends on the particular scenario or operational anomaly. In an example, pressure in the production tubing 18 is at or above a value that creates multi-pointing or another anomalous situation, and that is identified by monitoring pressure downhole such as described above; an example of a corrective action is to open a choke (not shown) on surface 21 to reduce pressure in the production tubing 18 to a level so that the pressure in the production tubing 18 is correspondingly reduced and the PPO valves $\mathbf{30}_{1\text{-}5}$ that are in the multi-pointing condition close. In another alternative of a corrective action the downhole surface controlled valve 38 is shifted to a smaller orifice size to reduce lift gas 24 flow through the valve 38 to reduce the production manifold pressure by reducing the gas flow inside the production tubing 18 and through the wellhead assembly 20. Other similar options are available depending on the particular set of circumstances. An advantage of the method and system described herein is the ability to detect that an operational anomaly is occurring, either through monitoring pressure downhole or surface controlled variation of lift gas flow into the production tubing 18; a further advantage is the ability to take action to correct the anomaly, where the action is through sending control signals (either automatically from the controller 40, or manually from an operator on surface 21) which does not require intervention to correct the situation.

Figure 7:
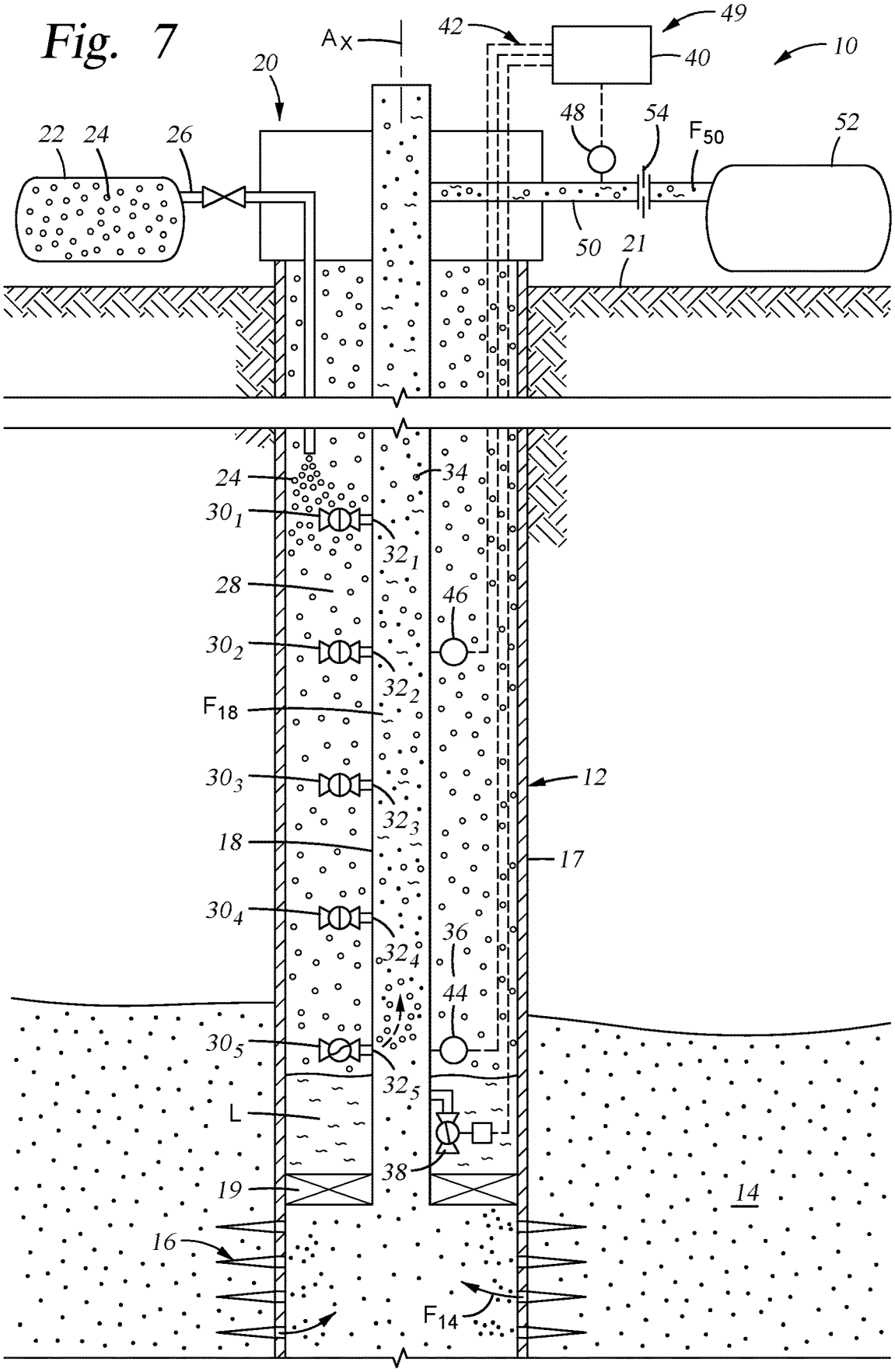
FIG. 7 is a schematic side sectional view of an example of the lift gas injection system of FIG. 1, and with a PPO valves experiencing chattering.

Shown in FIG. 7 is an example of operation of gas lift system 10 and in which PPO valves $\mathbf{30}_{1\text{-}4}$ are each in a closed configuration and not providing communication between the annulus 28 and inside of production tubing 18. Also in the example of FIG. 7, PPO valve $\mathbf{30}_5$ is in the open configuration and shown directing lift gas 24 into the production tubing 18 that forms gas bubbles 34. Further illustrated in FIG. 7 is that fluid $F_{50}$ is flowing in the production line 50, and that production line 50 extends to a terminal 52 where the fluid $F_{50}$ is delivered. Schematically illustrated within production line 50 is a restriction 54 that produces occasional pressure spikes that are transferred from within line 50 and back into fluid $F_{18}$ within production tubing 18, as shown the pressure spikes causes PPO valve $\mathbf{30}_5$ to move into a closed configuration temporarily. This condition eventually cycles and causes rapid opening and closing of PPO valves $\mathbf{30}_5$ to induce a situation known as chattering. Chattering is an undesirable situation as it can cause damage to the valve $\mathbf{30}_5$, and by reducing the introduction of lift gas 24 also limits production of fluid $F_{14}$. In the example of FIG. 7 the sensors 44, 46, 48 deliver pressure information to controller 40 so that controller recognizes the chattering condition of PPO valve $\mathbf{30}_5$, which is another known anomaly of PPO valves, and initiates corrective action by opening surface controlled valve 38 via its communication through the communication circuit 42. There are numerous situations that can cause chatter, in an example valve chatter is caused by unstable flow in which there is a pressure imbalance and that causes fluctuations in tubing pressure. As mentioned above, in some examples a choking anomaly at the surface causes an upper PPO valve to open. This in turn causes lift gas 24 to bypass the lower PPO valves and inject into the production tubing 18 closer to the surface, leading to reduced drawdown and reduced production. In some instances this eventually causes the production from the formation 14 to drop and reduces pressure in the production tubing 18. Then gas lift injection reinitiates sequentially downhole through the PPO valves $\mathbf{30}_{1\text{-}5}$ back down and the process happens again. Further in this example, monitoring conditions in the well 12, such as temperature, pressure, and flowrates provides information indicating a situation in which one or more of PPO valves $\mathbf{30}_{1\text{-}5}$ are in a state of chattering, are likely chattering, or tending to a chattering state. As noted above, the step of monitoring includes gathering information from one or more of surface controlled valve 38, sensors 44, 46, 48, and controller 42. In addition to identifying when or if valve chatter is occurring, the monitoring described herein also provides indications if multi-pointing is occurring or tending to a situation in which multi-point would or could occur. In some instances multi-pointing and chattering have similar causes. In alternate examples of operation, the complex and varying properties of the fluid $F_{18}$ result in multi-pointing, and change to unsteady chatter with a change in pressure as low as a few pounds per square inch.

Advantages of the intelligent well system 49 is that injection depth is inferred from the sensors 44, 46, 48 and controller 40. Alternatively, the sensors 44, 46, 48 include means for monitoring temperature. Examples exist in which additional sensors are located along the production tubing 18 and also in production line 50. In an alternative pressure readings from the sensors 44, 46, 48 (and possibly others) are used in the calculation of a pressure gradient for the tubing 18 and annulus 28. In an example of operation of this embodiment, during unloading a liquid level in the annulus 28 is inferred based a measured pressure gradient in the annulus 28 to indicate the depth of interface 36. Alternatively, during production the pressure gradient of the production string 18 is used. Further in this example injection from a specific surface controlled valves $\mathbf{38}_{1-n}$ is identified based on a step change in pressure gradient. During unload and prior to the gas injection reaching an uppermost or lowest depth surface, controlled step changes in bottom hole flowing pressure is an indicator that gas injection has reached a new injection point (examples of injection points include depths of PPO valves $\mathbf{30}_{1-5}$, surface controlled valves $\mathbf{38}_{1-n}$, and combinations. In an alternative, at any point production models are used to compare the pressure gradients to theoretical to expose any anomalous behavior. Examples exist where changes in the temperature gradient indicate gas injection at a specific surface controlled unit $\mathbf{38}_{1-n}$. It is pointed out that use of the gas lift system 10 with the PPO valves is not limited to unloading, but includes use for the production of hydrocarbon fluids from within a well.

In an embodiment of a hybrid system that includes a surface controlled system and PPO valves, full gas injection pressure is applied at the gas injection point; advantages of which include an improved drawdown. Optionally in this embodiment, the hybrid system remains in a stable operating mode at injection pressures at the surface that exceed injection pressures at which other systems having IPO valves would not be stable, and experience multi-pointing. Advantages of operating at higher pressures include increased drawdown and elimination of a need for a well workover to utilize additional injection pressure if it becomes available. Another advantage provided by the hybrid system is the ability to detect and correct an anomaly caused by the lift gas 24 having slugs of liquid (such as water or condensate) which accumulate in the annulus 28, and from the annulus 28 make their way into the production tubing 18 through surface operated valve 38 or one or more of the PPO valves $\mathbf{30}_{1-5}$. In some operational scenarios, these slugs of liquid cause chatter and/or multi-pointing in one or more of valves $\mathbf{30}_{1-5}$, which can be detected with the present system, and corrected with the injection of lift gas 24 through surface operated valve 38.

In a non-limiting example of operation, data is interpreted to determine when the well has been unloaded to the surface controlled section, and then designated surface controlled units are actuated to direct flow into selected areas. More specifically, in this example information from surface controlled valve 38 or one or more of sensors 44, 46, 48 to determine when lift gas 24 or interface 36 reaches the surface controlled valve 38. In an alternative, this information is obtained with information from a single one of sensors 44, 46 48 in conjunction with a known surface pressure or watching the rate of change of the downhole pressure.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of lifting liquid from a well comprising:

injecting lift gas into production tubing through production pressure operated ("PPO") valves that are in selective communication with a string of production tubing in the well;

monitoring conditions in the production tubing;

identifying a condition in the production tubing indicating one or more of the PPO valves is experiencing an anomaly; and correcting the anomaly by altering a characteristic of fluid in the production tubing by directing a signal from surface to a surface controlled valve to adjust the amount of lift gas being injected into the production tubing.

2. The method of claim 1 wherein the step of identifying a condition in the production tubing indicating one or more of the PPO valves is experiencing an anomaly comprises monitoring pressure at different depths in the production tubing.

3. The method of claim 1 wherein correcting the anomaly comprises an action selected from the group consisting of adjusting a rate of lift gas injection into the production tubing through the surface controlled valve and adjusting pressure of fluid flowing from the production tubing.

4. The method of claim 1 further comprising adding lift gas into the production tubing through the surface controlled valve.

5. The method of claim 1, wherein the liquid comprises liquid produced from a formation and that is directed into an end of the production tubing.

6. The method of claim 1, wherein the gas is directed into the production tubing through the PPO valves.

7. The method of claim 1, wherein an anomaly is defined by one or more of the PPO valves simultaneously injecting lift gas, and wherein the anomaly is identified based on a pressure profile in the production tubing.

8. The method of claim 1, wherein the pressure profile is developed by periodically and temporarily varying an orifice size in the surface controlled valve, and monitoring pressure at locations in the production tubing.

9. A method of well operations comprising:

providing lift gas into a well comprising production tubing, production pressure operated ("PPO") valves on the production tubing, casing that lines the well, and an annulus defined between the producing tubing and the well, the PPO valves are selectively changed between an open configuration to define a path for a portion of the flow of the lift gas to enter into the production tubing from the annulus, and a closed configuration to block the flow of the lift gas to enter into the production tubing from the annulus;

directing the lift gas into the annulus;

maintaining a flow of the lift gas at a substantially constant rate into the annulus;

determining an anomalous operation of the PPO valves by monitoring conditions in the well; and correcting the anomalous operation of the PPO valves by adding lift gas into the production tubing through a valve that is controlled from surface.

10. The method of claim 9 further comprising maintaining a pressure of the lift gas at which one of the PPO valves in designed to be in an open configuration and that PPO valves at a lesser depth are designed to be in a closed configuration.

11. The method of claim 9 wherein the condition comprises pressure.

12. The method of claim 11 wherein the anomalous operation is corrected by adjusting pressure in the production tubing.

13. The method of claim 11 wherein the anomalous operation is corrected by adjusting an amount of lift gas being injected into the production tubing by surface controlled valve.

14. The method of claim 11, wherein the pressure is monitored in one or more of the production tubing, and in the annulus around the production tubing.

15. A system for use in well operations comprising:

a source of lift gas having a line in communication with an annulus in the well that is defined between production tubing and casing that lines the well;

production pressure operated ("PPO") valves provided at different depths along the production tubing that are selectively changed between an open configuration that forms a path through a sidewall of the production tubing and provides communication between the annulus and inside of the production tubing, and a closed configuration that forms a barrier in the path;

a surface actuated valve that is changeable between an open configuration that forms a path through a sidewall of the production tubing and provides communication between the annulus and inside of the production tubing, and a closed configuration that forms a barrier in the path; and a controller that identifies an anomalous operation of the PPO valves, and corrects the anomalous operation of the PPO valves by selectively configuring the surface actuated valve into the open configuration.

16. The system of claim 15 wherein pressure in the production tubing is monitored by the controller.

17. The system of claim 16 wherein pressure in a flow production line on surface is monitored by the controller, and wherein the controller identifies the anomalous operation of the PPO valves based on the monitored pressures.

18. The system of claim 15 wherein the surface actuated valve is at a greater depth than the PPO valves.

19. The system of claim 15 further comprising pressure sensors and control lines, and wherein the controller, pressure sensors, and control lines define a communication circuit.

* * * * *